US007174123B1

(12) United States Patent
Miller

(10) Patent No.: US 7,174,123 B1
(45) Date of Patent: Feb. 6, 2007

(54) RIGID AGITATOR AND SHAFT ASSEMBLY

(75) Inventor: Steven Miller, Mobile, AL (US)

(73) Assignee: Cartridge Corporation of America, Inc., Clearwater, FL (US)

( * ) Notice: Subject to any disclaimer, the term of this patent is extended or adjusted under 35 U.S.C. 154(b) by 149 days.

(21) Appl. No.: 11/120,684

(22) Filed: May 3, 2005

Related U.S. Application Data

(63) Continuation-in-part of application No. 10/907,470, filed on Apr. 1, 2005, which is a continuation of application No. 10/742,323, filed on Dec. 19, 2003, now Pat. No. 7,136,608.

(51) Int. Cl.
*G03G 15/08* (2006.01)
*G03G 15/10* (2006.01)

(52) U.S. Cl. ..... 399/263; 399/27; 399/61

(58) Field of Classification Search ..... 399/25, 399/27, 61, 119, 120, 263
See application file for complete search history.

(56) References Cited

U.S. PATENT DOCUMENTS 6,603,933 B1 * 8/2003 Foegelle ..... 399/27
6,641,134 B1 * 11/2003 Dobbertin et al. ..... 271/226
6,646,571 B1 * 11/2003 Soar et al. ..... 341/13

* cited by examiner

*Primary Examiner*—Hoang Ngo
(74) *Attorney, Agent, or Firm*—Thomas E. Toner; Smith & Hopen , P.A.

(57) ABSTRACT

A toner cartridge includes a waste bin and hopper designed with a rigid agitator assembly. A non-yieldable agitator is mounted on a shaft whereby the rotation of the shaft results in the synchronous rotation of the agitator. As the shaft rotates, the agitator enters into, through, and out of engagement with the toner within said toner chamber.

7 Claims, 5 Drawing Sheets

RIGID AGITATOR AND SHAFT ASSEMBLY

CROSS REFERENCE TO RELATED APPLICATIONS

This application is a continuation-in-part to co-pending U.S. patent application Ser. No. 10/907,470 entitled: "Integrated Toner Cartridge with Toner Agitator and Sensing Device," filed Apr. 1, 2005, which is a continuation of U.S. patent application Ser. No. 10/742,323 entitled: "Removable Toner Cartridge Universal Adapter," filed Dec. 19, 2003 now U.S. Pat. No. 7,136,608.

BACKGROUND OF THE INVENTION

Laser printers use a coherent beam of light, hence the term "laser printer," to expose discrete portions of an image transfer drum thus attracting the printing toner. Toner is a mixture of pigment (most commonly black) and plastic particles. The toner becomes electrostatically attracted to exposed portions of the image transfer drum. The toner is transferred to paper, or other medium, as it passes over the rotating image transfer drum. Subsequently, the paper is heated so that the plastic is melted thereby permanently affixing the ink to the paper.

The vast majority of commercially available desktop laser printers include replaceable or removable toner cartridges that incorporate an image transfer drum, a toner tank, and a metering system. A drive mechanism is connected to the drum and metering system. Modern toner cartridges often include a variety of sensors that interact with the laser printer to indicate the status of the cartridge. Indications relating to toner level, print quality and general cartridge function are often included as well. A large number of types and sizes of toner cartridges are currently available. The sensing system typically includes an encoder wheel interconnected with a rotating agitator within a cylindrical toner tank. Movement of the agitator feeds toner into the metering system. The encoder wheel reports the movement of the agitator through the toner reservoir.

A particular failure of the devices of the prior art is the use of a yieldable drive assembly in the agitating mechanism. Such agitating mechanisms require low profiles to minimize drag as they move through the toner so that the agitator can spring forward as soon as the end of the agitating mechanism exits the toner. The resulting low profile agitating mechanisms don't optimize agitation of the toner.

Furthermore, the torque exerted upon a yieldable drive apparatus is concentrated on the outer tip of the yieldable drive shaft. Furthermore, impulse forces can shear the tip of the shaft where the range-of-motion limiting device is connected when the yieldable drive paddle contacts toner that has become packed (during non-use).

SUMMARY OF INVENTION

The long-standing but heretofore unfulfilled need for a toner cartridge that is adapted to be of an simplified construction, thereby limiting the number of elements required during manufacture, and which also includes improvements that overcome the limitations of prior art toner cartridges is now met by a new, useful, and non-obvious invention.

The novel toner cartridge is adapted to fit within a toner cartridge-receiving cavity of a printer, and comprises a toner chamber with a shaft mounted for rotation therein. An agitator is mounted on the shaft whereby the rotation of said shaft results in the synchronous rotation of said agitator. As the shaft rotates, the agitator enters into, through, and out of engagement with the toner within said toner chamber.

A light blocking wheel is disposed in integral, and in non-yielding engagement, with a distal end of the shaft at a point external of said toner chamber. In this embodiment rotation of the shaft results in synchronous rotation of said light blocking wheel. At one end of the agitating assembly, a drive gear is disposed integrally, and in non-yielding engagement, with a distal end of said shaft at a point external of said toner chamber. As with the light blocking wheel, rotation of said drive gear results in synchronous rotation of said shaft and agitator.

A window is present at a point along the outer circumference of the light blocking wheel to allow the printer to find a home position. Without the presence of the window, the printer would generate an error message which would cease operation of the printer.

The agitator of the present invention includes angled and straight support members disposed between said agitator and said shaft. Each support member is equipped with a plurality of alternating angled tooth members disposed along a toner engaging surface of said support members. This configuration provides an optimum mixing surface for the toner. Additionally, the angled tooth members help to chip away toner which has become packed during non-use.

It is therefore an object of the present invention to provide a non-yieldable drive mechanism that can be used with a ratcheting gear mechanism as described in International Patent Application PCT/US 05/11,160 entitled "Integrated Toner Cartridge with Toner Agitator and Sensing Device."

It is another object of the instant invention to provide a non-yieldable drive with fewer moving parts, which can fail, than that of the prior art. The additional parts required by the prior art pose numerous disadvantages, such as: higher cost associated with assembly and manufacture; the use of additional bushings; and failure due to binding of non-essential moving parts.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment the novel toner cartridge has a photoconductive drum on which an electrostatic image is formed. The photoconductive drum rotates in a plane perpendicular to that of the print medium passing through the toner cartridge. A recovery blade is placed in direct contact with the photoconductive drum. During the imaging stage, the photoconductive drum is exposed to light, usually a laser, which imprints a latent image thereon. A developing roller converts the electrostatic-image into a toner-image. Toner is then transferred to the print medium by means of static electricity, an opposite polar charge on the print medium, established by a transfer roller. The recovery blade then scrapes the waste toner from the photoconductive drum and directs it to the waste bin.

CONSTRUCTION OF THE NOVEL TONER CARTRIDGE

Rigid Agitator and Shaft Assembly

Figure 1A:
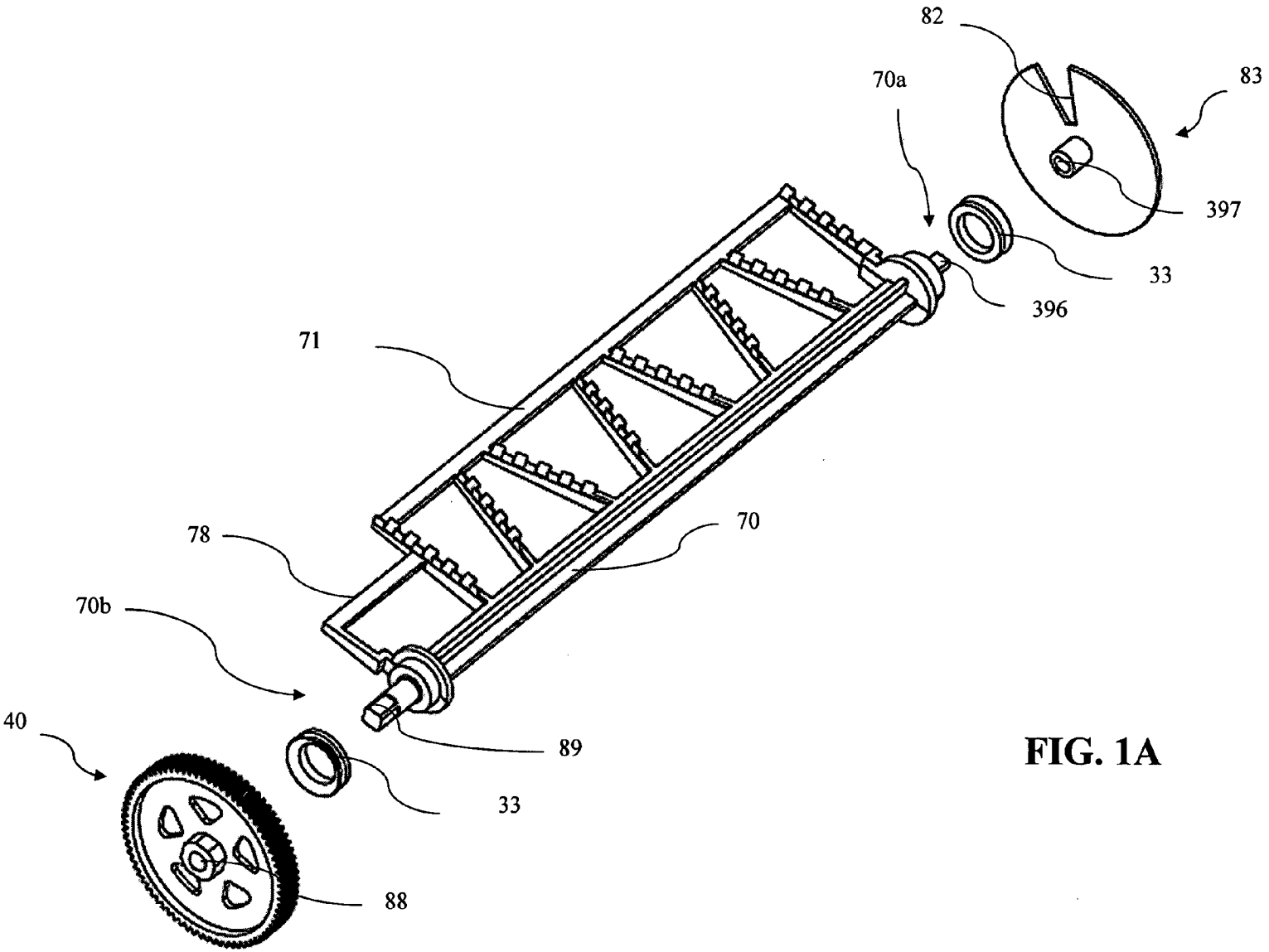
FIG. 1A is a semi-exploded perspective view of the novel rigid agitator and shaft assembly.
Figure 1B:
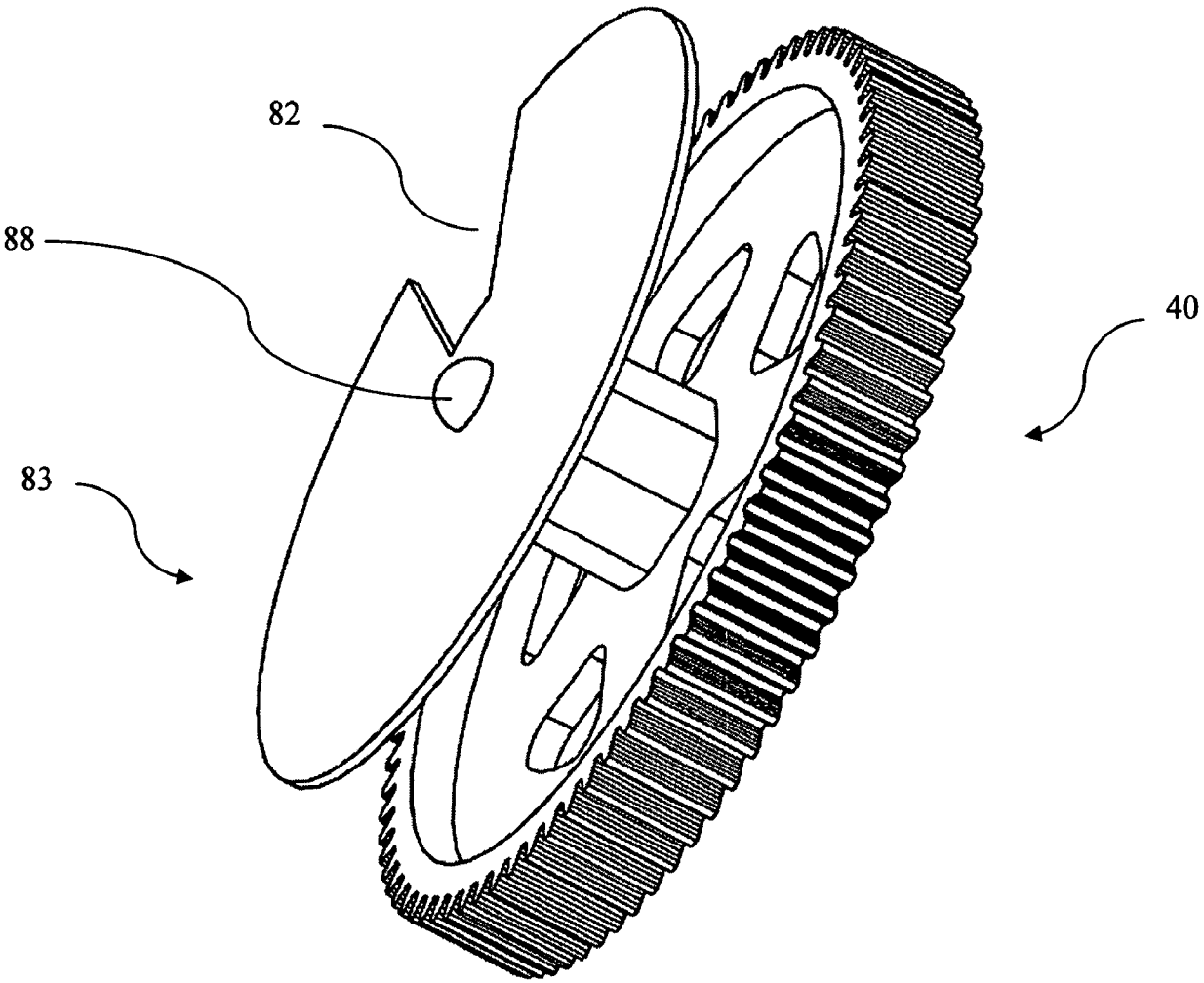
FIG. 1B is a perspective view of the light blocking wheel and drive gear in an alternate embodiment wherein both components are located on the drive side of the novel toner cartridge.
Figure 1C:
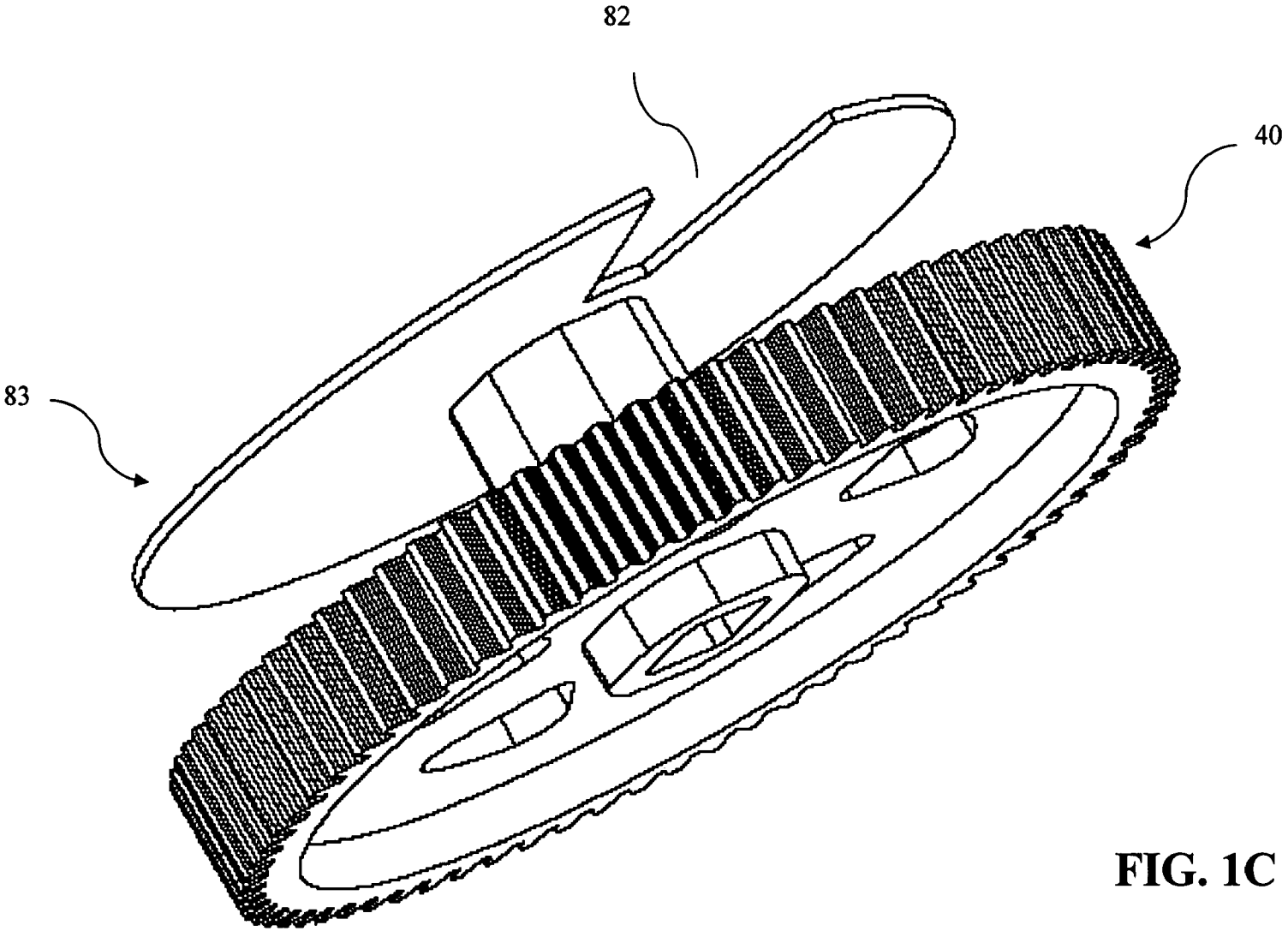
FIG. 1C is an alternate perspective view of the light blocking wheel and drive gear in an alternate embodiment wherein both components are located on the drive side of the novel toner cartridge.

It will now be seen, referring to FIGS. 1A–1C, the novel toner cartridge of the instant invention includes light blocking wheel 83. As shown in FIG. 1A light blocking wheel 83 is disposed on the driven side of the novel toner cartridge adapted but FIGS. 1B & 1C show light blocking wheel 83 can also be formed integrally with drive gear 40 on the drive side thereof.

In the embodiment shown in FIG. 1A light blocking wheel 83 is mounted on the driven end 70*a* of agitator shaft 70. Agitator shaft 70 is coaxially mounted for rotation within the toner chamber of the novel toner cartridge. Light blocking wheel 83 remains in synchronous rotation with shaft 70 via the non-yielding engagement of shaft key 396 and wheel lock 397. Seal 33 is disposed at the driven end 70*a* of shaft 70 between shaft 70 and light blocking wheel 83. Seal 33 prevents the escape of toner from the novel toner cartridge.

Drive side 70*b* of shaft 70 mates with drive gear 40 in non-yielding engagement. Drive gear 40 is equipped with protrusion 88 which engages the outer wall of the toner cartridge on the drive side. In the embodiment shown in FIGS. 1B and 1C protrusion 88 is disposed on the outer side of light blocking wheel 83 rather than drive gear 40. Drive-side key 89 mates with and engages drive gear 40. The non-yielding engagement of shaft 70 to both drive gear 40 and light blocking wheel 83 ensures that the toner agitating assembling, comprising these elements, remains in synchronous rotation throughout operation of the toner cartridge. Such synchronous rotation ensures that the full force of rotation provided by drive gear 40 is exerted throughout the agitating apparatus.

Figure 2:
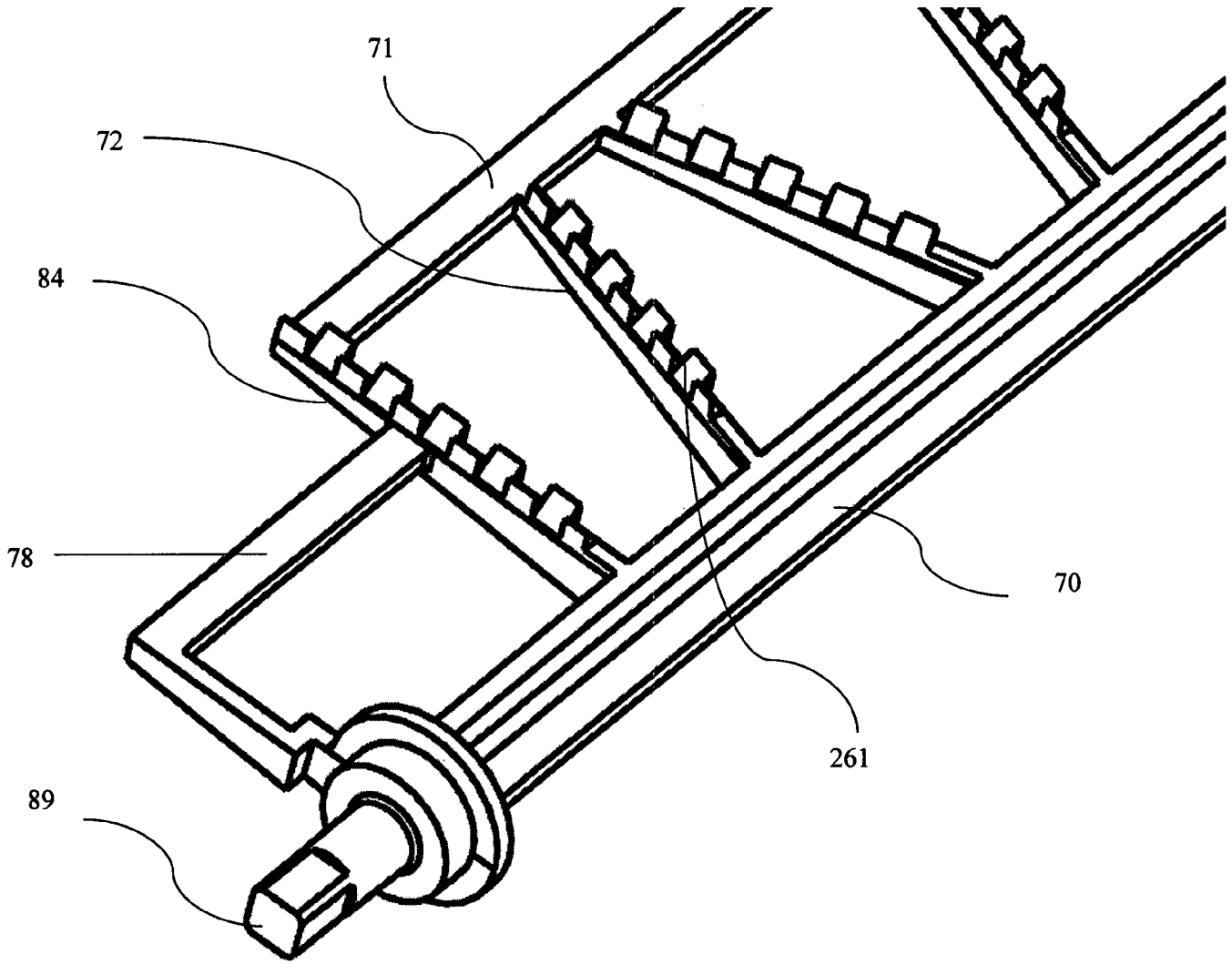
FIG. 2 is a close-up perspective view of the driven end of the novel apparatus.

Extending radially from shaft 70 and axially along the toner chamber is toner agitator 71. As toner agitator 71 rotates toner is urged from the toner chamber toward the toner adder roller, as is known in the art. As is shown in FIGS. 1A and 2, toner agitator 71 is supported on shaft 70 by angled support members 72 and straight support members 84. Ancillary support agitator 78 is disposed at the distal end of shaft 70 adjacent to drive gear 40.

Figure 3:
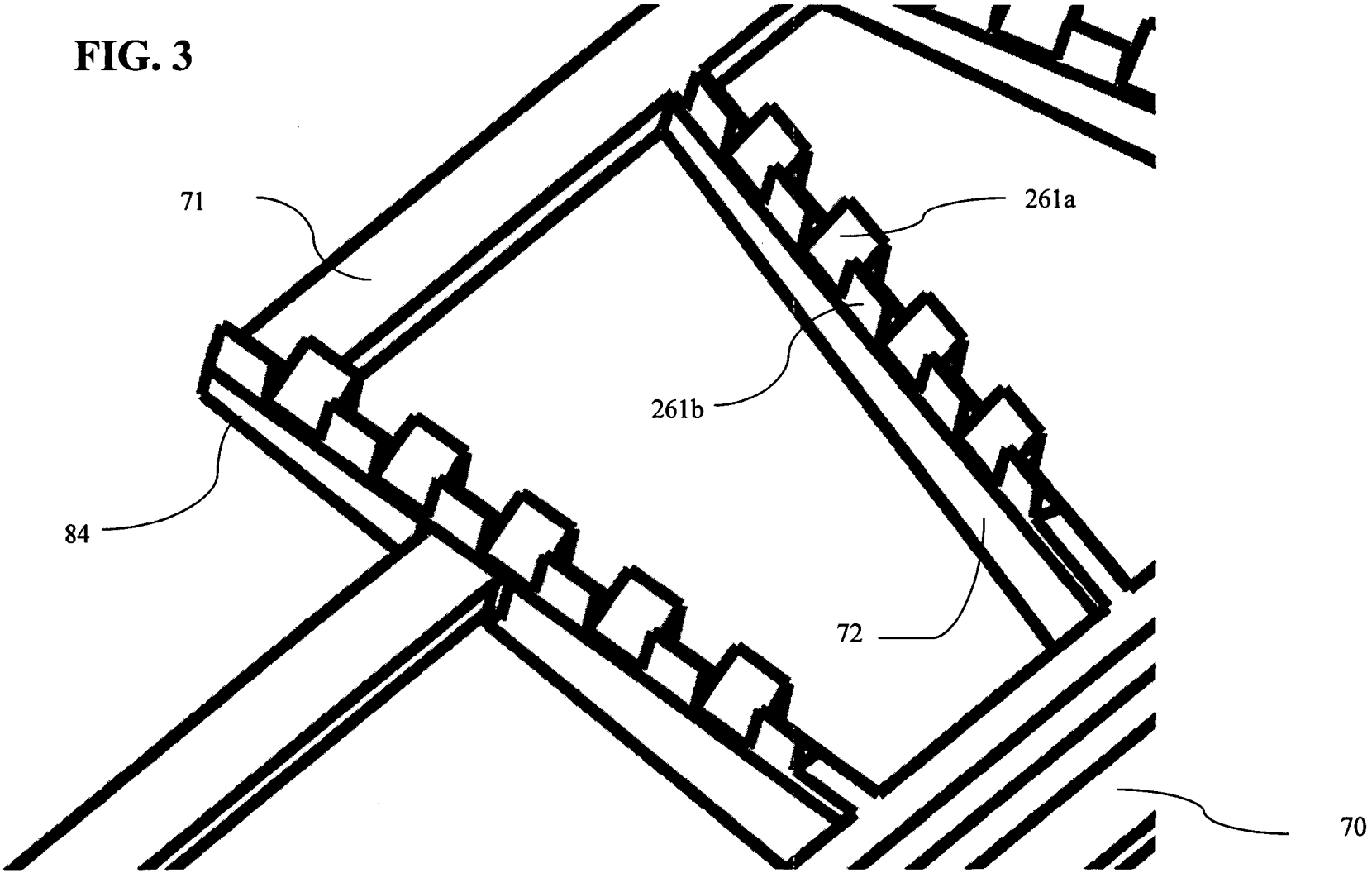
FIG. 3 is a close-up perspective view of the alternating tooth members of the novel apparatus.

As is shown in FIGS. 1A and 2, straight supports 84 and angled supports 72 have a series of alternating tooth members 261. The angled design and alternate orientation of tooth members 261*a* and 261*b*, detailed in FIG. 3, provides a configuration which optimizes agitation of the toner in the toner chamber. Tooth members 261*a* and 261*b* are also uniquely disposed to aide in chipping apart and driving through compact toner, that is toner which has hardened while in storage or non-use.

Most printers employ a photo-optic system that determines the toner level by determining the location and timing measurements of indicia embedded on a timing disk (analogous in structure to light blocking wheel 83) When the printer starts its initialization sequence, a light sensitive sensor in the printer identifies the position of the window on the timing disk and relays a signal to the intelligence in the host printer which references the position of the window as the home position. The home position is necessary for the printer to complete the initialization sequence. An error signal is generated when the home position cannot be determined, thus disabling operation of the printer.

Light blocking wheel 83 is equipped with home window 82 to accommodate this feature of existing printers. It is worthy of note that light blocking wheel 83 does not aide the toner cartridge of the instant invention, or the host printer, to measure the volume of toner remaining in the toner chamber. Home window 82 is included on light blocking wheel 83 to allow the host printer to identify a home position.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described,

What is claimed is:

1. A toner cartridge adapted to fit within a toner cartridge-receiving cavity of a printer, comprising:

a toner chamber;

a shaft mounted for rotation within said toner chamber;

an agitator mounted on said shaft whereby the rotation of said shaft results in the synchronous rotation of said agitator into, through, and out of engagement with the toner within said toner chamber;

a light blocking wheel integral, and in non-yielding engagement, with a distal end of said shaft at a point external of said toner chamber whereby rotation of said shaft results in synchronous rotation of said light blocking wheel; and a drive gear integral, and in non-yielding engagement, with a distal end of said shaft at a point external of said toner chamber whereby rotation of said drive gear results in synchronous rotation of said shaft.

2. The toner cartridge of claim 1 further comprising a home window disposed within said light blocking wheel.

3. The toner cartridge of claim 1 further comprising angled support members disposed between said agitator and said shaft.

4. The toner cartridge of claim 3 further comprising angled tooth members disposed along a toner engaging surface of said angled support members.

5. The toner cartridge of claim 1 further comprising straight support members disposed between said agitator and said shaft.

6. The toner cartridge of claim 5 further comprising angled tooth members disposed along a toner engaging surface of said straight support members.

7. The toner cartridge of claim 1 further comprising an ancillary agitator disposed at one end of said shaft.

* * * * *

UNITED STATES PATENT AND TRADEMARK OFFICE

CERTIFICATE OF CORRECTION

PATENT NO. : 7,174,123 B1
APPLICATION NO. : 11/120684
DATED : February 6, 2007
INVENTOR(S) : Steven Miller It is certified that error appears in the above-identified patent and that said Letters Patent is hereby corrected as shown below:

On patent cover page item (60) under Related U.S. Application Data, Line 2, after "continuation", insert -- in part --

In Specification, Column 1, Line 9, after "continuation", insert -- in part --

Signed and Sealed this

Seventeenth Day of August, 2010

David J. Kappos

David J. Kappos
*Director of the United States Patent and Trademark Office*